US005207038A

United States Patent [19]

Negri

[11] Patent Number: 5,207,038

[45] Date of Patent: May 4, 1993

[54] REINFORCED EARTH STRUCTURES AND METHOD OF CONSTRUCTION THEREOF

[76] Inventor: Yermiyahu Negri, 4 Recanati Street, Tel Aviv, Israel

[21] Appl. No.: 895,165

[22] Filed: Jun. 5, 1992

Related U.S. Application Data

[63] Continuation of Ser. No. 567,898, Aug. 15, 1990, abandoned.

[30] Foreign Application Priority Data

Jun. 4, 1990 [IL] Israel ..... 94604

[51] Int. Cl.[5] ..... E02D 27/44; E02D 29/04

[52] U.S. Cl. ..... 52/169.6; 405/149; 405/262; 405/286

[58] Field of Search ..... 405/52, 55, 124, 149, 405/262, 133, 286; 52/169.6; 109/15

[56] References Cited

U.S. PATENT DOCUMENTS

| | | | |
|---|---|---|---|
| 1,746,566 | 2/1930 | Tufts | 405/149 |
| 3,562,987 | 2/1971 | Eakin | 405/55 X |
| 3,596,419 | 8/1971 | Jalbert | 52/169.6 X |
| 3,620,025 | 11/1971 | Taradash et al. | 405/152 |
| 4,189,891 | 2/1980 | Johnson et al. | 52/169.6 X |
| 4,557,634 | 12/1985 | Vidal | 405/286 |
| 4,618,283 | 10/1986 | Hilfiker | 405/149 X |
| 4,648,743 | 3/1987 | Sauer | 405/149 X |
| 4,717,285 | 1/1988 | Pulkkinen | 405/133 X |
| 4,718,792 | 1/1988 | Louis | 405/262 |
| 4,874,272 | 10/1989 | Egan | 405/286 X |
| 4,968,186 | 11/1990 | Ogorchock | 405/262 |
| 5,024,036 | 6/1991 | Johnson | 405/262 X |

FOREIGN PATENT DOCUMENTS

| | | | |
|---|---|---|---|
| 113543 | 7/1984 | European Pat. Off. . | |
| 115912 | 8/1984 | European Pat. Off. . | |
| 460891 | 12/1991 | European Pat. Off. . | |
| 2511424 | 2/1983 | France | 52/169.6 |
| 21009 | of 1967 | Israel . | |
| 35046 | of 1967 | Israel . | |
| 2014212 | 8/1979 | United Kingdom . | |
| 1563317 | 3/1980 | United Kingdom . | |
| 2152973 | 8/1985 | United Kingdom . | |

OTHER PUBLICATIONS

Reid R. A: Full Scale-Blast Test of a Reinforced Soil Bunker S. International Symposium, Mannheim, Germany Apr. 22-26, 1991.

*Primary Examiner*—David H. Corbin
*Assistant Examiner*—Arlen L. Olsen
*Attorney, Agent, or Firm*—Dennison, Meserole, Pollack & Scheiner

[57] ABSTRACT

A structure comprising a vertical load and supporting structure therefor, characterized in that the vertical load supporting structure comprises concrete slab cladding of a reinforced earth structure, said cladding comprising at least two tiers of concrete slabs, and method of construction thereof.

18 Claims, 3 Drawing Sheets

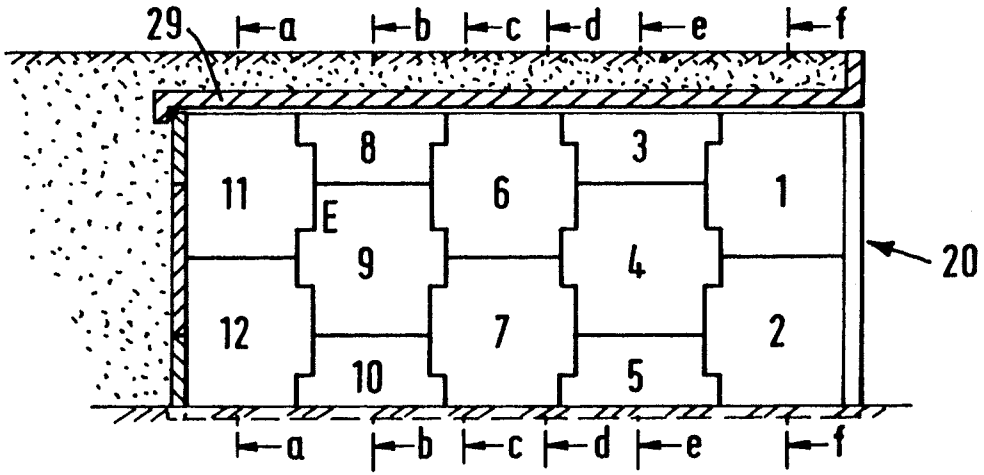
FIG.4.
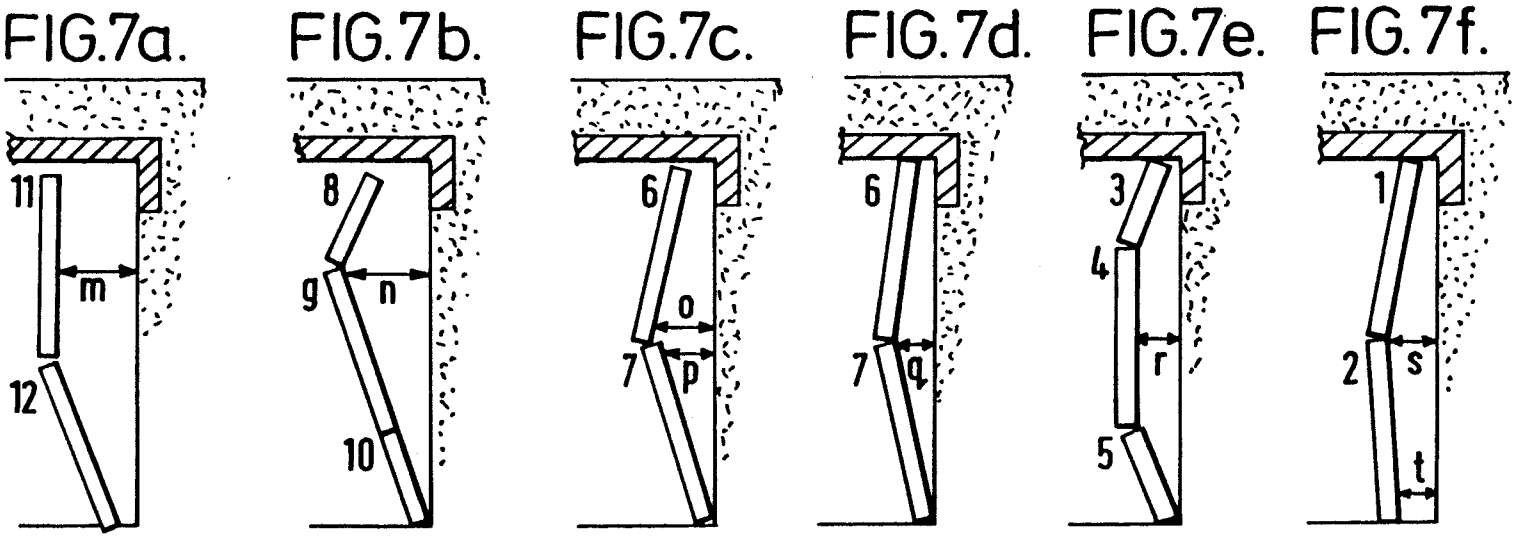

REINFORCED EARTH STRUCTURES AND METHOD OF CONSTRUCTION THEREOF

This is a continuation of copending application U.S. Ser. No. 07/567,898 filed on Aug. 15, 1990, now abandoned.

FIELD OF THE INVENTION

The present invention relates to reinforced earth structures, specifically to reinforced earth structures having load bearing cladding.

BACKGROUND OF THE INVENTION

Reinforced earth construction technology is well developed and established in the construction field. This technology involves reinforcing earth, which becomes a cohesive material of great strength and stability, by the association of granular soil and reinforcements. Through friction, tensile stresses are transferred to the reinforcements, improving the mechanical properties of the soil. A facing, usually of interlocking suitable panels, provides an aesthetically pleasing finish and serves as an anchor for the reinforcing elements. Such reinforced earth provides a coherent gravity mass that can be engineered for a variety of load bearing requirements The reinforced earth mass has also been used for retaining walls and bridge abutments on highway projects, as well as other civil engineering requirements, such as sea walls, dams and bulk storage facilities. Israel Patent No. 21009 disclosed the characteristic methods of calculating and applying reinforced earth as a construction technique. Specifically a reinforced earth structure comprises a mass of particles normally extracted from the natural ground and reinforcing straps embedded in the mass, said reinforcing straps providing frictional contact with the grains or particles. These reinforcements ensure that the structure is stable. The free vertical surface of the reinforced structure is faced with cladding or skin for retaining the particles which are located in the vicinity of the said free surface and which are therefore not subject to the frictional retaining effect of the reinforcing straps. The above mentioned patent discloses cladding consisting of U-section elements in superimposed relation, having adjacent flanges of elements in contact with one another.

Israel Patent No. 35046 discloses cladding elements in the form of a plate or slab comprising means for fixing the cladding elements to the ends of the reinforcing straps, the slabs having edge portions which allow a relative displacement between adjacent slabs and a seal for preventing earth particles from passing between adjacent slabs.

Israel Patent No. 50515 discloses a specific type of reinforcing strap having traverse ribs extending over the full length of the strip to provide better friction with earth and improve the reinforcement for structures of reinforced earth. Today slabs of the type disclosed in Israel Patent 35046 are the most common cladding for reinforced earth structures. These slab claddings are usually arranged in an interlocking manner with the edges of one slab engaging those of the adjacent slab in tongue and groove arrangement. Reinforced earth can thus be prepared with a vertical end surface of 20 meters and more, having a cladding or facing of concrete slabs layered one upon the other to the very top of the structure, each concrete slab providing a barrier for lateral displacement of the ground adjacent to it, to which it is anchored by reinforcing straps.

SUMMARY OF THE INVENTION

The concrete slab claddings have heretofore been used exclusively as a facing for reinforced structures. It was thought that the cladding is not capable of supporting vertical loads, since it is composed of discrete elements with flexible joints between them. All vertical loads associated with reinforced earth structures were applied on the earth at the back of the cladding or transferred to underlying strata by other means such as piles or columns.

The applicant has discovered that suitable cladding of reinforced earth structures can serve as load-supporting walls, capable of receiving vertical loads. The horizontal forces in the straps, which are anchored to the cladding elements are translated into vertical reactions which enable the discrete elements to accept substantial vertical forces with very small deflections well within tolerable limits.

Furthermore, it was discovered that cladding elements subject to vertical bearing loads were less prone to cave in when subjected to both internal and external blast forces. The vertical forces on the elements were translated into horizontal reactions, due to friction, which increased the resistance at the cladding elements to horizontal deflections.

It is the object of the present invention to provide vertical load bearing reinforced earth structures, said vertical loads being borne by the reinforced earth concrete slab claddings.

It is a further object of the invention to provide security structures using load-bearing concrete slab claddings to support a roof having a substantial load.

Yet another object of the invention is to provide a method of construction wherein concrete slab cladding of reinforced earth structures serve as load-bearing walls.

In accordance with this invention there is provided a vertical load bearing reinforced earth structure, said load being borne by concrete slab cladding of said reinforced earth structure, said cladding comprising at least two tiers of concrete slabs. In a preferred embodiment of this invention, the concrete slabs of the cladding are interlocking.

The applicant has discovered that suitable cladding of reinforced earth structures can serve not only as facing for anchorage of the straps to prevent lateral displacement of the adjacent earth, but also as vertical load supporting walls, although such walls are not vertically rigid, but rather comprise multiple tiers of concrete slabs disposed one on the other.

Furthermore, it was discovered that concrete roof structures supported by reinforced earth concrete slab cladding were less prone to cave in when subjected to both internal and external blast forces.

BRIEF DESCRIPTION OF THE DRAWINGS

The present invention is illustrated by way of example only in the accompanying drawings, in which:

FIG. 4 illustrates in detail a load bearing wall of reinforced earth cladding;

FIGS. 7*a* to 7*f* illustrate the displacement of concrete slab sections of the wall of FIG. 4 after an explosion within the earth outside the structure.

DETAILED DESCRIPTION OF THE PREFERRED EMBODIMENT(S)

Figure 1:
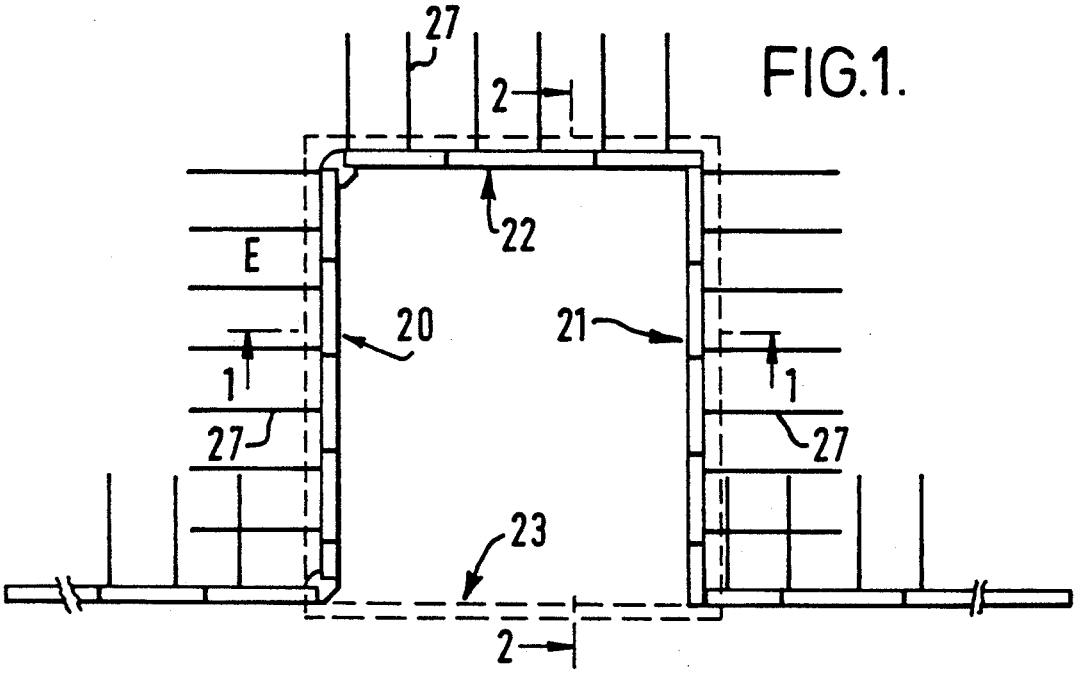
FIG. 1 represents a top view of a preferred reinforced earth structure according to the invention.
Figure 2:
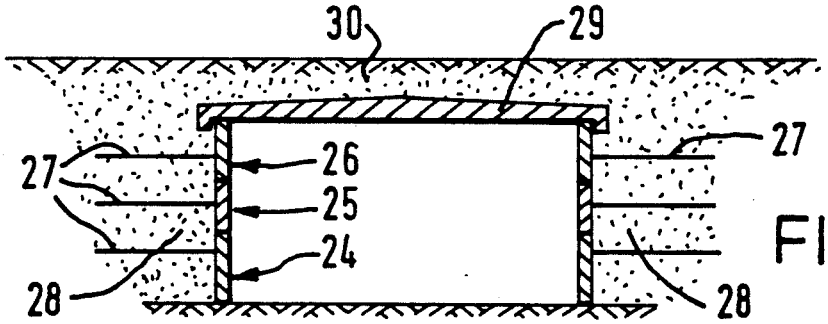
FIG. 2 is a cross-section of the structure in FIG. 1 taken along line 1—1.
Figure 3:
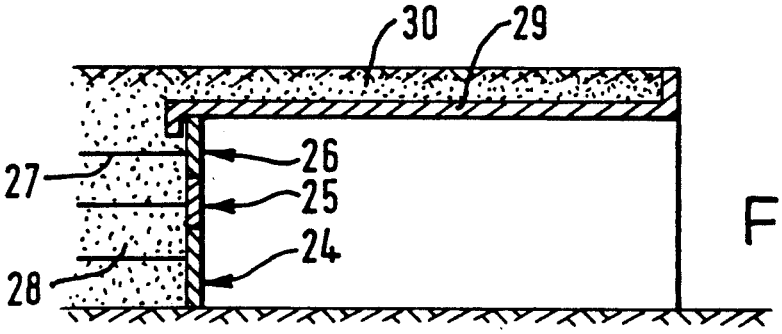
FIG. 3 is a cross-section of the structure of FIG. 1 taken along line 2—2.

Referring now to FIGS. 1–3, there are shown top and cross-sectional views respectively of a rectangular load bearing reinforced earth structure in accordance with the invention. The structure consists of three vertical load bearing walls 20, 21 and 22 and one open side 23. Each of the walls 20, 21 and 22 is comprised of three tiers 24, 25 and 26 of pre-cast concrete slab cladding anchored in position by reinforcing straps 27 buried in the earth 28. The slabs are interlocking one with the other (FIG. 4) in both horizontal and vertical directions. A concrete roof 29 is cast in place and is supported solely by the walls 20, 21 and 22. The structure is covered with earth 30 which makes it undetectable from the air. The pre-cast concrete slabs used to make the load bearing wall may be of the conventional type, having a cross-shaped and interlocking configuration (FIG. 4), and in the present example wall 20 comprises twelve slabs numbered 1–12 comprising several basic configurations, as is known in the art. Thus, for example, slab 4 has a basic shape for interlocking on four sides with adjacent slabs. Slabs 3 and 5 are respectively terminal upper and lower slabs with the upper and lower edge respectively smoothly finished.

Figure 5:
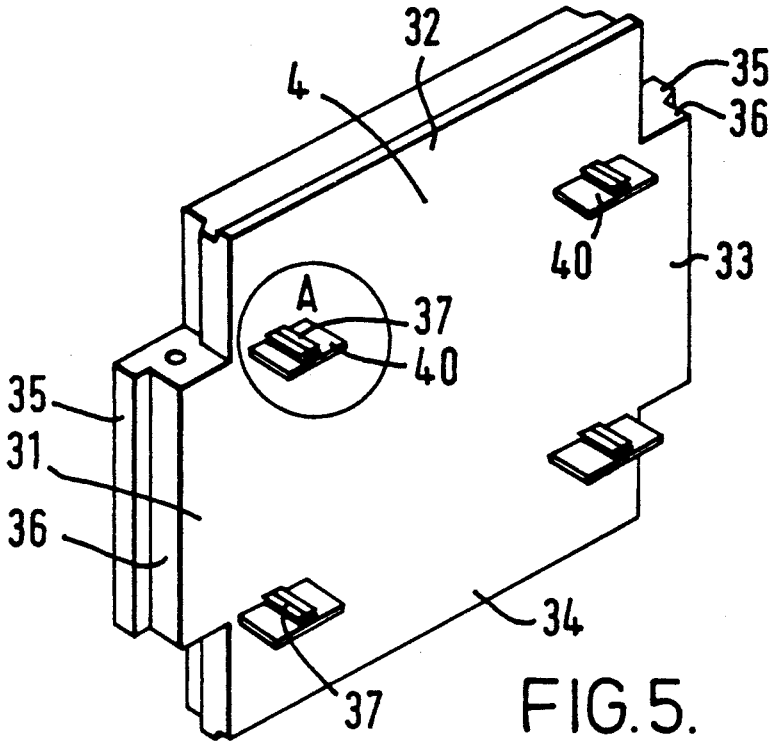
FIG. 5 shows a standard shape concrete slab element used for cladding reinforced earth as in FIG. 4.
Figure 6:
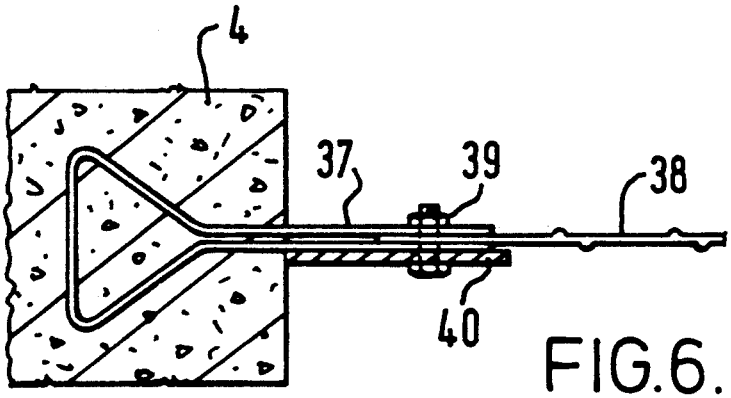
FIG. 6 is an enlarged view of section A in FIG. 5 illustrating means for anchoring reinforcing strips on the concrete slab.

Detailed construction of slab 4 is illustrated in FIG. 5. The cross-sectional joints 31, 32, 33 and 34 have a tongue 35 for engaging an adjacent slab in a corresponding groove 36 in a tongue and groove arrangement. Anchors 37 are embedded in the concrete slab 4, as can better be seen in FIG. 6. Flexible reinforcing straps 38 are fixed to the anchors 37 by means of bolts 39. Horizontal steel plate flanges 40 at the connection between the cladding element and the strap can optionally be introduced to further improve the interaction between the horizontal force exerted by the strap and the resistance to vertical forces applied on the cladding elements. Thus by using cladding having horizontal flanges, the vertical deflections under the static vertical loads as well as horizontal deformations of a structure subjected to blast loading will be further reduced, enabling construction of vertical load supporting walls without building a foundation.

As was discussed previously, the technology of reinforced earth structure using the reinforced earth to support loads is well-known and the concrete slab cladding for use in retaining walls of such structure has been detailed in Israel Patent No. 35046. No-one has previously considered or thought feasible the use of the concrete slab cladding wall itself as a vertical load bearing construction element. To demonstrate the advantage of this invention, an experiment was conducted wherein an explosive device was detonated in the earth outside of a reinforced earth roofed structure as shown in FIGS. 1–4 having the following dimensions: length 7.35 m, width 5.34 m and height 3 m, with the typical slab 4 illustrated in FIG. 5 having the dimensions $x=1.335$ m and $y=1.505$ m. In the above structure at the location marked E (FIGS. 1 and 4), a quantity of TNT to simulate a standard store containing 30 tons of TNT was detonated and the effect of the blast on the wall 20 of FIG. 4 is shown in FIGS. 7*a* to 7*f* which illustrate cross sections of the wall taken at a—a, b—b, c—c, d—d, e—e and f—f respectively. In general it can be said that the structure retained its integrity and the roof remained supported by the cladding walls, although individual cladding sections were displaced. Thus we see that the wall sections 11, 8 and 9 (FIGS. 7*a* and 7*b*) which were closest to the source of the blast had the greatest displacement (m and n) 65.5 and 71.1 cm respectively from their original vertical position. Nevertheless, these sections did not totally collapse and remained interlocked with adjacent sections to provide adequate support for the roof 29 and prevent its collapse. As the distance from the blast source E increased (FIGS. 7*c*, *d*, *e* and *f*), the cladding displacement decreased, thus the distances o,p,q,r,s and t are 57.3, 38, 47.6, 28, 17.1 and 6.2 cm respectively. The blast caused the slabs to buckle but not to crumble, and the interlocking arrangement of the cladding provided a sufficient measure of flexibility to absorb the shock and merely displace the slabs, which remained anchored in the reinforced earth.

Such an explosion in a structure having the same dimensions but made with conventional concrete walls supporting a concrete roof would cause the walls to cave in and the roof to crash, making the structure unsuitable for security needs.

According to this invention, therefore, it is possible to rapidly construct heavy roofed structures at lower costs for ammunition storage bunkers and other security structures such as bomb shelters. Furthermore, because of the fact that these structures are able to withstand internal and external blasts better than conventional structures, ammunition depots made of such structures can be constructed at closer intervals one from the other since the debris and shock forces of internal explosion are spread over a much shorter distance.

Similarly, the interior of these structures is better able to absorb the shocks of external explosions significantly reducing the ricocheting of debris therein. Thus bomb shelters made of such structures can safely be provided with stone tile flooring, which is not the case with conventionally constructed bomb shelters. Other applications of this invention include the construction of bridge abutments with shorter spans, thus eliminating elaborate support platforms which are presently required for carrying loads on reinforced earth.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A structure comprising spaced support means defining an interior area, an external vertical load laterally spanning the defined area freely supported by said spaced support means, at least one of said spaced support means comprising a first wall substantially supporting the weight of said vertical load and including at least two tiers of vertically stacked concrete slabs, a reinforced earth fill structure generally coextensive with said wall exterior of said defined area and in bearing engagement with said wall, a plurality of flexible reinforcing strap means fixed to each of said slabs and extending laterally into frictional engagement within said earth fill structure said slabs having edge portions abutting corresponding edge portions of adjacent slabs so as to accommodate limited relative lateral displacement of at least some of said concrete slabs of said wall upon subjection of the said structure to lateral blast loading while substantially maintaining the integrity of said structure and supporting said vertical load.

2. The structure of claim 1 wherein said vertical load comprises a concrete roof.

3. The structure of claim 2 wherein said vertical load includes earth fill over said concrete roof.

4. The structure of claim 1 comprising a shelter.

5. The structure of claim 1 comprising depot for explosives.

6. The structure of claim 1 including plate flanges fixed to each slab and extending laterally therefrom into said reinforced earth structure.

7. The structure as in claim 1 comprising a bridge or section thereof.

8. The structure of claim 1 wherein said spaced support means includes a second wall of at least two tiers of vertically stacked concrete slabs, a reinforced earth fill structure generally coextensive with said second wall exterior of said defined area and in bearing engagement with said second wall, a plurality of flexible reinforcing strap means fixed to each of said slabs of said second wall and extending laterally into frictional engagement with the corresponding earth fill structure, said slabs of said second wall having edge portions abutting corresponding edge portions of adjacent slabs so as to accommodate limited relative lateral displacement of at least some of said concrete slabs of said second wall upon subjection of said structure to lateral blast loading while maintaining the integrity of said structure.

9. The structure of clam 8 wherein said vertical load comprises a concrete roof.

10. The structure of claim 9 wherein said vertical load includes earth fill over said concrete roof.

11. The structure of claim 8 including horizontal plate flanges secured to each slab and said plate flanges extending laterally therefrom into the earth, said plate flanges to further improve resistance to horizontal forces.

12. A structure comprising a laterally and inwardly extending external vertical load, a wall receiving and substantially supporting said vertical load, said wall comprising at least two tiers of concrete slabs placed vertically on top of one another, a reinforced earth fill structure lateral outwardly of said wall, a plurality of flexible reinforcing strap means fixed to each of said slabs laterally engaging said reinforced earth fill structure, said slags having edges formed to cooperate with adjacent slabs for relative displacement between adjacent slabs, said wall supporting the external load even after displacement in response to lateral blast loading.

13. A method of constructing a freely supported vertical load bearing structure capable of accommodating a lateral explosive blast loading, said method comprising casting concrete slabs to define opposed major faces and a plurality of interconnectable edges, forming a wall by stacking said concrete slabs on their edges in at least two tiers, positioning the edges of adjacent slabs to allow for relative displacement between adjacent slabs upon said lateral explosive blast loading, forming a reinforced earth fill structure to one of said major faces of said wall, anchoring each of said slabs laterally to said reinforced earth fill structure with a plurality of flexible reinforcing strap means, and positioning a vertical load on and extending laterally away from the other said major face of said wall so that said wall receives a substantial portion of the weight of said vertical load.

14. The method of claim 13 including the steps of forming a second wall in laterally spaced relation to said first mentioned wall to define an area therebetween, said second wall being formed by stacking concrete slabs on their edges in at least two tiers, positioning the edges of adjacent slabs of said second wall to allow for relative displacement between adjacent slabs, forming a reinforced earth fill structure to one side of said second wall exterior of said defined area, anchoring each of said slabs of said second wall laterally to the joining reinforced earth fill structure with a plurality of flexible reinforcing strap means, and positioning said vertical load to span said area and seat in supported engagement on said two walls.

15. The method in accordance with claim 14 wherein the structure defined is a shelter.

16. The method in accordance with claim 14 wherein the structure defined is a depot for explosives.

17. The method in accordance with claim 13 wherein the structure defined is a bridge or section thereof.

18. A method of constructing a sub-surface load bearing structure surrounded by earth fill, including load bearing walls and a freely supported horizontal load, said structure capable of resisting forces resulting from an explosion comprising the steps of:

casting concrete slabs to define opposed major faces and a plurality of interconnectable edge portions, securing a plurality of flexible elongated reinforcing strap means into one major face of each of said slabs, extending said flexible reinforcing strap means away from said structure and into the surrounding earth fill, stacking said concrete slabs on complementary edge portions to form a flexible wall of at least one lower and one upper tier, backfilling earth against said one major face of said slabs for completely burying said flexible straps therein for frictional engagement, positioning a vertical load freely supported on and substantially said walls and extending laterally away from the opposite side of said one major face and achieving cooperation between the earth fill and the flexible reinforcing straps to resist collapse of said structure from said explosion whereby the integrity of said load bearing structure is maintained.

* * * * *